US008513557B2

(12) United States Patent
Währenberg

(10) Patent No.: US 8,513,557 B2
(45) Date of Patent: Aug. 20, 2013

(54) ACTUATOR DEVICE AND AN ELECTRIC SWITCH DEVICE PROVIDED THEREWITH

(75) Inventor: Joakim Währenberg, Västerås (SE)

(73) Assignee: ABB AB, Västerås (SE)

( * ) Notice: Subject to any disclaimer, the term of this patent is extended or adjusted under 35 U.S.C. 154(b) by 270 days.

(21) Appl. No.: 12/988,347

(22) PCT Filed: Oct. 20, 2008

(86) PCT No.: PCT/EP2008/064097

§ 371 (c)(1),
(2), (4) Date: Oct. 18, 2010

(87) PCT Pub. No.: WO2009/127269

PCT Pub. Date: Oct. 22, 2009

(65) Prior Publication Data

US 2011/0036698 A1 Feb. 17, 2011

Related U.S. Application Data

(60) Provisional application No. 61/071,262, filed on Apr. 18, 2008.

(30) Foreign Application Priority Data

Apr. 18, 2008 (EP) ..... 08154823

(51) Int. Cl.
*H01H 13/58* (2006.01)

(52) U.S. Cl.
USPC ..... 200/520; 200/523; 200/526; 200/329; 200/334

(58) Field of Classification Search
USPC ..... 200/520, 523, 526–529, 537–539, 200/542, 318–318.2, 329–331, 334, 341, 200/500, 501, 323–325
See application file for complete search history.

(56) References Cited

U.S. PATENT DOCUMENTS 4,703,141 A * 10/1987 Grunst ..... 200/318.2
5,043,546 A * 8/1991 Krause ..... 200/527

(Continued)

FOREIGN PATENT DOCUMENTS

CN 1346500-(A) 4/2002
CN 1416582-(A) 5/2003

(Continued)

OTHER PUBLICATIONS

PCT/ISA/210—International Search Report—Feb. 13, 2009.

(Continued)

*Primary Examiner* — Michael Friedhofer
(74) *Attorney, Agent, or Firm* — Venable LLP; Eric J. Franklin

(57) ABSTRACT

An actuator device including a holder element provided to be fixed against a device operated on by the actuator device. An actuator body is displaceable in a longitudinal direction along the holder element. A guide member is provided so as to guide the actuator body along the holder element. The actuator body includes a first part that is operable from outside the actuator device, and a second part that is movable in the longitudinal direction in relation to the first part. The actuator body is displaceable to a first, non-actuated position, in which the first part and the second part of the body are movable in the longitudinal direction and a second, actuated position, in which the second part is rotationally displaced in relation to the first part and abuts an abutment surface on the holder element such that motion of the second part in the longitudinal direction towards the first position is inhibited. The first part includes a rotational locking member that engages the second part in the second position and locks the second part rotationally in the second position.

27 Claims, 4 Drawing Sheets

(56) References Cited

U.S. PATENT DOCUMENTS

| | | | | |
|---|---|---|---|---|
| 5,178,265 | A * | 1/1993 | Sepke | 200/528 |
| 5,493,089 | A * | 2/1996 | Chasen et al. | 200/523 |
| 5,593,022 | A | 1/1997 | Schaeffer et al. | |
| 6,268,577 | B1 * | 7/2001 | Marquardt et al. | 200/330 |
| 6,483,062 | B1 * | 11/2002 | Herdegen et al. | 200/538 |
| 7,232,965 | B2 * | 6/2007 | Gibbons et al. | 200/17 R |
| 7,342,194 | B2 * | 3/2008 | Karweik et al. | 200/329 |
| 8,207,466 | B2 * | 6/2012 | Singh et al. | 200/538 |

FOREIGN PATENT DOCUMENTS

| | | |
|---|---|---|
| CN | 1551267-(A) | 12/2004 |
| CN | 200990317-(Y) | 12/2007 |
| CN | 201036210-(Y) | 3/2008 |
| WO | WO-00/60621 A | 10/2000 |

OTHER PUBLICATIONS

PCT/ISA/237—Written Opinion of the International Searching Authority—Feb. 13, 2009.

Notification of the First Office Action, issued by the State Intellectual Property Office of the People's Republic of China on Oct. 24, 2012, in connection with counterpart Chinese Patent Application No. 200880128575.4.

* cited by examiner

ACTUATOR DEVICE AND AN ELECTRIC SWITCH DEVICE PROVIDED THEREWITH

CROSS-REFERENCE TO RELATED APPLICATIONS

This application claims priority to European patent application 08154823.2filed 18 Apr. 2008 and U.S. provisional patent application 61/071,262 filed 18 Apr. 2008 and is the national phase of PCT/EP2008/064097 filed 20 Oct. 2008.

TECHNICAL FIELD

The present invention relates to an actuator device comprising a holder element, provided to be fixed against a device operated on by the actuator device, an actuator body displaceable in a longitudinal direction along said holder element, a guide means provided so as to guide said actuator body along said holder element, wherein said actuator body comprises a first part, which is operable from outside the device, and a second part, which is movable in said longitudinal direction in relation to the first part, and wherein said actuator body is displaceable in the longitudinal direction from a first, non-actuated position to a second, actuated position, in which said second part is rotationally displaced in relation to said first part and abuts an abutment surface on the holder element such that motion of the second part in the longitudinal direction towards the first position is inhibited. "Rotationally displaced" should be understood as rotationally displaced in relation to the rotational position adopted by the second part in relation to the first part in the first position.

The invention also relates to an electric switching device that comprises an actuator device according the invention and an electric device on which the actuator body of the actuator device exerts a force in said longitudinal direction and to which the holder element of the actuator device is fixedly attached. Typically, but not necessarily, the actuator is an emergency stop operator and the electric device operated on is a set of contact blocks, i.e. a breaker. Preferably, but not necessarily, the electric device operated on by means of the actuator device of the invention is a low voltage device, i.e. a device in which the applied voltage is below 1 kV.

Preferably, the holder element is a sleeve, in which the actuator body is displaceable in a longitudinal direction thereof, wherein the actuator body is connected to a handle or push button for the external handling thereof, and arranged so as to exert a force on said electric device upon displacement thereof from the above-mentioned first position to the second position, typically for the purpose of acting on a contact block such that an electric circuit is broken. However, the invention also includes the inversed function, i.e. opening of an electric circuit by such actuation.

BACKGROUND OF THE INVENTION

Emergency stop operators are used in connection to electric machines for the purpose of actuating one or more contact blocks that control the flow of electric current through such machines. The contact blocks define switches or breakers. Normally, the emergency stop operator comprises a handle by means of which an actuator body in the operator is pushed in a direction towards the contact block in order to generate the breaking of an electric circuit through a displacement of individual contacts in the contact block.

Prior art includes operators in which the actuator body is spring loaded and provided with a latch means formed by a pin that, once the actuator body has been pushed to an active position, such as the initially defined second position, will abut an abutment surface of a sleeve that guides the actuator body and is fixedly attached to the contactor block. The pin may be spring loaded and the abutment surface thereof, or the abutment surface of the sleeve, may be inclined such that the pin will be depressed and will pass the abutment surface upon a given counterforce from the contact block. Accordingly, the actuator body may accidentally return to its first, inactive, position if the counterforce exerted by the contact block is large enough. This is a drawback of this type of operators, since the spring-loading of the pin must be adapted to the different counterforce that may exist depending on the type and number of contact blocks acted upon by the operator.

In order to remedy such drawbacks prior art includes a design as initially defined in this application. According to the teaching of this prior art the second part of the actuator body is a so called gear ring, provided with a plurality of inclined abutment surfaces arranged so as to engage with corresponding abutment surfaces on the inner periphery of the holder element. The gear ring is free to rotate in relation to the first part of the actuator body. The first part of the actuator body is in direction contact with the contactor block. The gear ring is able to slide longitudinally along a central part of the first part of the actuator body. The abutment surfaces of the gear ring and the corresponding abutment surfaces of the sleeve are arranged such that, upon displacement of the actuator body from the first to the second position, and provided that there is a counter pressure from the contact block, the gear ring will be moved to a position in which it rides on a first abutment surface and rotationally moves to a position in which it is located in a stable abutting position, thereby preventing itself and the first part from moving back towards the first position. Each abutment surface of the sleeve is formed as a double cam. Upon a further pushing of the actuator body in the same direction, though from the second position, the gear ring will move in the longitudinal direction in relation to the sleeve abutment, will pass a top of the latter and will slide down the abutment surface of a second cam thereof, thereby rotating slightly, and will eventually go free from the double-cam abutment and will be able to return to the first position.

Prior art also include solutions in which there is required a rotation of the handle in order to achieve the requested result.

However, the above-mentioned kind of double push manoeuvring of the actuator body, and the handle, of this emergency operator of prior art in order to activate and deactivate the operator may be found somewhat illogical. It would be more logical to simply push the handle, or button, connected to the actuator body in a straight rectilinear direction in order to activate the actuator, and to pull back the button or handle in a corresponding opposite rectilinear direction in order to deactivate the actuator.

THE OBJECT OF THE INVENTION

It is an object of the present invention to present an actuator device of a design that enables the actuator body to displaced from the first position to the second position by pushing the actuator body in a first direction, and enables the actuator body to be displaced from the second position to the first position only by pulling the first part of the actuator body in a direction opposite to the first direction.

The design of the actuator device should also be such that, in the second position, the first part of the actuator body is unloaded, and such that pushing back of the actuator body by the counterforce from the device operated on is prevented and not dependent on the spring-loading of the actuator body or any latch means or pin connected thereto.

SUMMARY OF THE INVENTION

The object of the invention is achieved by means of the initially defined actuator device, characterised in that said first part comprises a rotational locking means that engages said second part in said second position and locks it rotationally in that position. Thereby, the first part, which is locked in a predetermined rotational position by the guide means, will lock the second part in a rotational position in which the latter abuts the abutment surface or surfaces of the holder element and inhibits a motion thereof towards the first position. However once the first part is refracted in the opposite direction, i.e. pulled back towards the first position, such that it looses its rotationally locking engagement with the second part, the latter will be able to rotate to a position in which it does not abut the abutment surface or surfaces of said abutment of the holder element. In order to enable such rotational motion of the second part, the abutment surfaces of either the holder element or the second part should be sloping and free from any depression that might generate a stable abutment position. Accordingly, the abutment between the second part and the holder element preventing the second part from moving towards the first position in the longitudinal direction in the in the second position is of an unstable type, and will be released once the rotational locking of the second part ceases. In the first position, the locking means are inactive, and there is no interlocking of the first and second parts by means thereof. The use of the term "rotational locking means" does not imply that the means in itself is rotational, but primarily that it locks such that a rotational motion of the second part in relation to the first part is inhibited. Rotation is referred to as a rotating motion around a rotational axis parallel with said longitudinal direction, and preferably in relation to the holder element, which should be fixed in relation to a device operated on when being in its operative position. It should also be mentioned that it is assumed that the device operated on by means of the actuator device applies a counter force on said second part when the latter is in the second position, thereby striving to push the actuator body back to the first position.

According to a preferred embodiment, in the first position, said first part and said second part are rotationally locked by said guide means, and in said second position only said first part is rotationally locked by said guide means.

Preferably said rotational locking means comprises at least one projection projecting in the longitudinal direction of the first part. It is preferred that the second part abuts an end of such a projection in the first position. Such a projection will then, upon rotation of the second part, be able to engage a corresponding recess in the second part and rotationally lock the latter, such as is the case in the above-mentioned second position. Preferably, said at least one projection extends in the longitudinal direction of the first part and is engaged with said guide means. Preferably, the guide means comprises a plurality of splines or ribs with running in the longitudinal direction of the holder element. The at least one projection engages these ribs and rotationally locks the first part in relation to the holder element.

According to one embodiment said rotational locking means comprises an inclined abutment surface at an end thereof towards said second part. It is preferred that the second part abuts this inclined abutment surface. Thereby, once a position in the longitudinal direction in which the second part is no longer rotationally locked by the guide means is reached, the inclined abutment surface will induce a rotational sliding motion of the second part to a rotational position in which the projection is able to engage a corresponding recess in the second part. Preferably, said at least one projection comprises a first wall surface extending in said longitudinal direction, a sloping abutment surface extending from a top of said wall, and, possibly, a second wall surface extending in the longitudinal direction from an opposite end of the sloping abutment surface. Between two projections there is a recess in which a corresponding projection of the second part may rest.

Preferably, said rotational locking means comprises a plurality of projections projecting in the longitudinal direction of the first part. Thereby, small rotational displacements of the second part may be induced by said projections. Preferably, each projection presents an inclined end surface forming an abutment surface against which a corresponding surface of the second part rests in the first position of the actuator body. In accordance with this teaching, the first part presents a corresponding recesses between each part of projections. Provided that the second part comprises at least one projection arranged to abut the end of any such projection in the first position, that projection of the second part will be able of sliding into an adjacent recess of the first part upon rotation thereof into the second position, and rotational locking will be achieved.

According to one embodiment said plurality of projections are distributed along an annular path at the end of said first part. Preferably, the projections define a step ring, preferably arranged so as to cooperate with a corresponding step ring defined by the second part. However, it should be understood that a plurality of alternative embodiments fall within the scope of the invention. For example, the number of projections on first and second part may differ largely, the important feature being that the projections of one part fits in the recesses of the other part, in order to promote a tight rotational locking and a smooth transfer between first and second positions.

According to the invention, said second part comprises an engagement means arranged so as to engage said rotational locking means in said second position. This is a direct consequence of the fact that the first part comprises a means for rotational locking of the second part. Said locking means must have something to engage, and accordingly, the second part comprises such engagement means. These engagement means may, accordingly, as well be regarded as locking means for the rotational locking of the second part against the first part.

Preferably, said engagement means comprises at least one projection projecting in the longitudinal direction of the second part. Such a projection may cooperate with a recess between two corresponding projections of the first part in order to lock the second part rotationally in relation to the first part.

According to one embodiment, said at least one projection comprises an inclined abutment surface at an end thereof pointing towards said first part. As previously described for the first part, the inclination will promote a rotational displacement of the second part in relation to a corresponding abutment surface of the first part once the second part becomes rotationally unlocked by the guide means on its way to the second position, provided that there is a certain counter pressure from the device acted on by means of the present actuator body. Preferably, the at lest one projection of the second part has a design corresponding to or equal to the one previously described for the at least one projection of the first part.

According to the teaching of the invention, said at least one projection of the second part is in longitudinal alignment with said at least one projection of first part in said first position. Accordingly, in said first position, the abutment surface of the at least one projection of the first part abuts the at least one abutment surface of the second part. When the actuator body is moved towards the second position, the second part will be released from its engagement with the guide means. Due to the inclination of the abutment surfaces, and the counter pressure from the device acted upon, the second part will rotate a step, and the second part will slip into its rotational interlocking with the first part as the projections of the respective part projects into recesses between projections of the other part. Accordingly, in the second position, the second part will be closer to the first part in the longitudinal direction.

Accordingly, in said second position, said at least one projection of said second part is rotationally displaced in relation to a corresponding projection of the first part, and longitudinally displaced such that it overlaps the latter in said longitudinal direction.

Preferably, said second part comprises a plurality of said projections, said projections being distributed along an annular path at an end of said second part pointing towards said first part. It is preferred that the number of projections correspond to the number of projections on the first part. It is also preferred that the inclined abutment surfaces correspond to those of the first part such that, in the first position, the projections of the first part and second part that are in alignment with each other define continuous ribs in the longitudinal direction of the device.

According to the invention, said holder element comprises at least one abutment surface that, in said second position, abuts a corresponding abutment surface of the second part, thereby inhibiting said second part from moving longitudinally towards said first position. Preferably, the abutment surface of the second part is the abutment surface of said at least one projection, and preferably it is inclined in order to promote a sliding and a rotation of the second part from its rotational position in the second position to its rotational position in the first position upon refraction of the first part from the second position.

Preferably, the at least one abutment surface of the holder element is inclined, in order to promote a sliding and a rotation of the second part from its rotational position in the second position to its rotational position in the first position upon retraction of the first part from the second position. Thereby, the second part will slide off smoothly from said abutment, and will be able to follow the first part in the longitudinal direction towards the first position. Preferably, the inclination of the abutment surface or surfaces of the holder element has the same inclination direction, and preferably also the same inclination angle, as the abutment surface or surfaces of the first part.

Accordingly, in said second position, said inclined abutment surface of said at least one projection of said second part abuts a corresponding inclined abutment surface of the holder element.

As previously mentioned, it is preferred that said guide means comprises at least one rim extending in the longitudinal direction of the holder element.

Preferably, said guide means comprises a plurality of rims extending in the longitudinal direction of he holder element and distributed on a peripheral surface of the holder element.

It is also preferred that said at least one inclined abutment surface of the holder element is formed by an end of said guide means. Preferably, when the guide means comprises a plurality of rims or splines, each such rim has an inclined end surface towards acting as an abutment surface against corresponding abutment surfaces of the second part. The abutment surface of each rim defines a single cam, in contrast to the double cam design of push-push operators of prior art. In other words the abutment surface cooperating with an abutment surface of the second part is a single sloping surface at an end of a projection, preferably formed by a rim of the guide means. Thereby, the abutment position, i.e. the second position, will be unstable and will require the rotational locking of the second part by means of the first part in cooperation with the guide means on order to be retained.

It is a characterising feature of he present invention that, during displacement of the actuator body from the first position to the second position, the second part of the actuator body is arranged such that a force exerted by operation of the first part is applied to a device operated on through said second part. In other words a force generated by, for example, manual pushing of a push button connected to the first part of the actuator body, will be transferred through the second part to the device thereby operated on.

It is also a feature of he preset invention that said second part is an end part of said body, through which a reaction force from a device operated on by the actuator device in said second position will be transferred to the holder element through said abutment surface of the holder element. In other words, since, in the second position, the second part of the actuator body is prevented from moving longitudinally back towards the first position due to the interaction of the locking means of the first part and the engagement means of the second part, and due to the fact that it abuts the abutment surfaces of the holder element, a counter pressure in the longitudinal direction from the device operated on will be adopted by the second part and the holder element. Thereby, the first part will be released from any counterforce acting in the longitudinal direction, and, accordingly, any possible spring loading thereof must not be adapted to the size of the counterforce of the device operated on.

According to a preferred embodiment, the actuator device comprises a latch element that is displaceable in a direction crosswise to said longitudinal direction and that, in said second position of he actuator body, abuts a second abutment on the holder element, thereby preventing the first part of said actuator body from accidentally returning to the first position. The latch element may be arranged so as to move in the longitudinal direction between a first position on one side of said second abutment, in the first position of the actuator body, and a second position on the opposite side of said second abutment, corresponding to the second position of the actuator body. Preferably the latch element is positioned in a fixed position in the longitudinal direction on the actuator body with regard to the position of said first part. The latch element, or another separate latch element, may be arranged such that a predetermined force, large enough for releasing said latch element from a longitudinally locking engagement with the holder element, must be applied on the actuator body, possibly through a handle, in order to permit displacement of the actuator body from the first position to the second position.

Preferably, at least one of said latch element or second abutment presents an inclined surface such that the latch element will be forced from its abutting engagement with the second abutment upon pulling of said first part in a direction from the second to the first position.

Preferably, the latch element is spring loaded in a direction cross-wise to the longitudinal direction of the actuator device. It is also preferred that there be an inclined surface on an actuator mechanism, connected to a handle or forming part o a handle, that will abut the latch element and displace the latter in the direction crosswise to the longitudinal direction upon displacement of said actuator mechanism in the longitudinal direction. Thereby, the crosswise displacement of the latch element in order to enable disengagement thereof from the holder element and displacement thereof from the first to the second position is to be achieved by pushing the handle and the actuator mechanism longitudinally towards the actuator body.

According to one embodiment, said holder element is a sleeve inside which said actuator body is displaceably arranged.

According to a preferred embodiment, the actuator element is an emergency stop operator.

The invention also relates to an electric switching device, characterised in that it comprises an actuator device according to the invention and an electric device on which the actuator body of the actuator device exerts a force in said longitudinal direction and to which the holder element of the actuator device is fixedly attached or at least fixedly positioned. The actuator body may, preferably, be arranged so as to displace a certain part of the device operated on, such as the contact blocks or a switch part of an electric breaker.

Thereby, it is preferred that said actuator device is an emergency stop operator and that said electric device comprises a contact block to be acted on by the emergency stop operator.

Further features and advantages of he present invention will be presented in the following detailed description of an embodiment thereof.

BRIEF DESCRIPTION OF THE DRAWINGS

Hereinafter an embodiment of the invention will be described more in detail with reference to the annexed drawing on which.

DETAILED DESCRIPTION OF THE INVENTION

Figure 1:
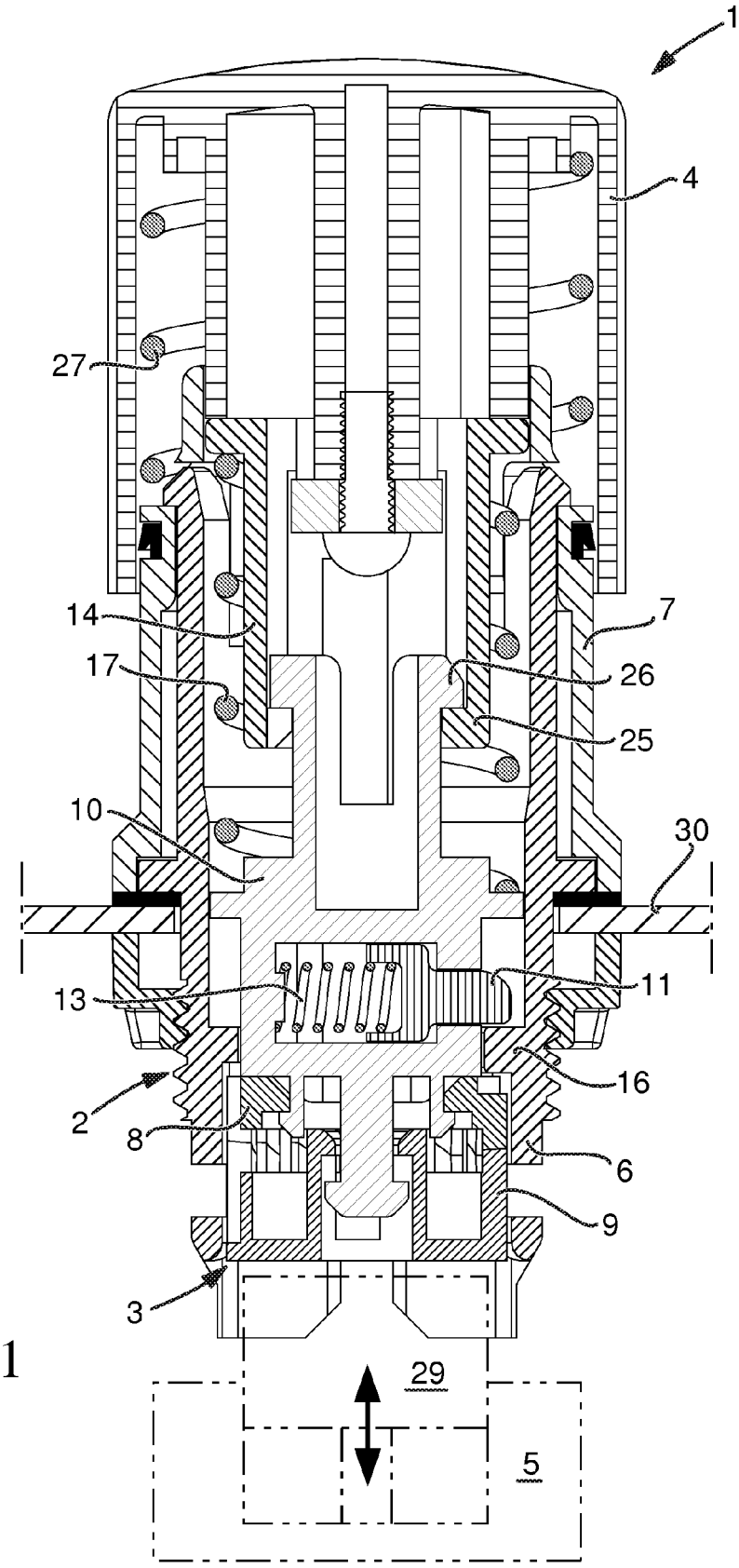
FIG. 1 is a cross-section of a an actuator device according to the invention with its actuator body in a first, inactive position.
Figure 2:
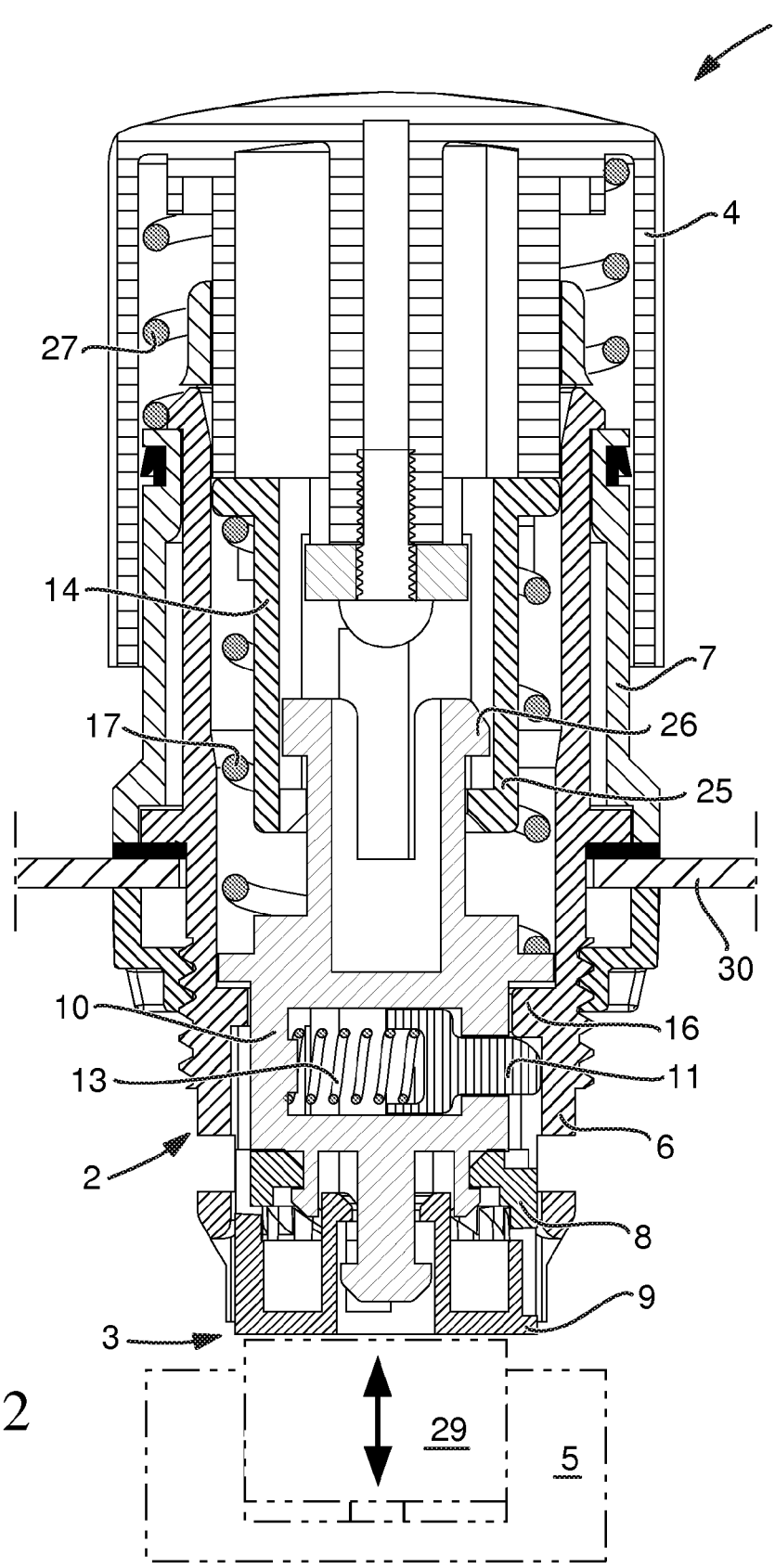
FIG. 2 is a cross-section corresponding to FIG. 1, but with the actuator body in a second, activated position.
Figure 3:
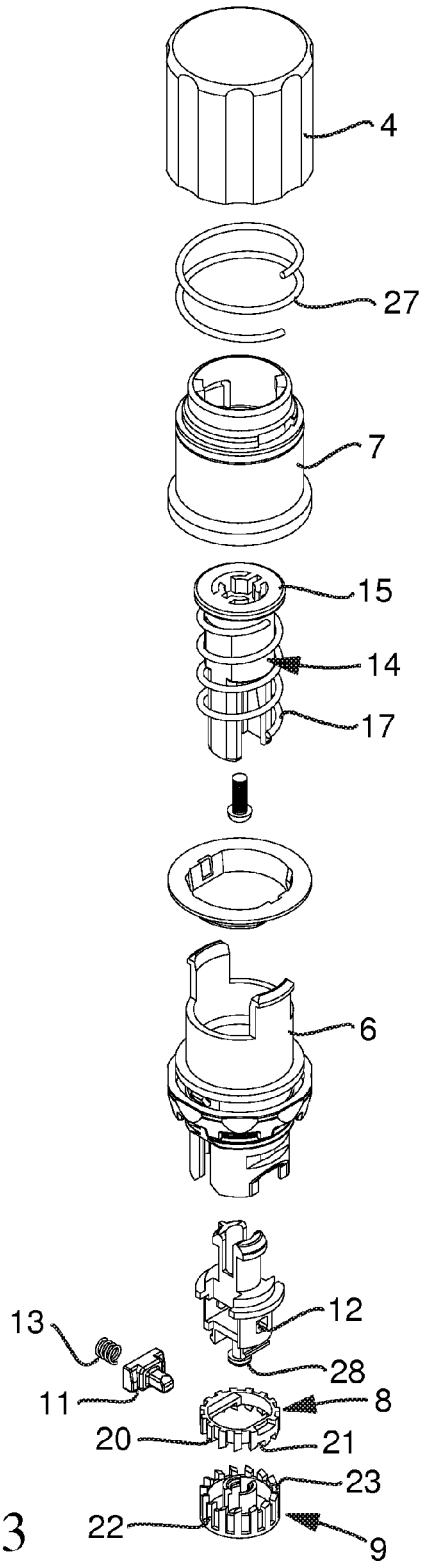
FIG. 3 is an exploded view of the actuator device shown in FIGS. 1 and 2.
Figure 4:
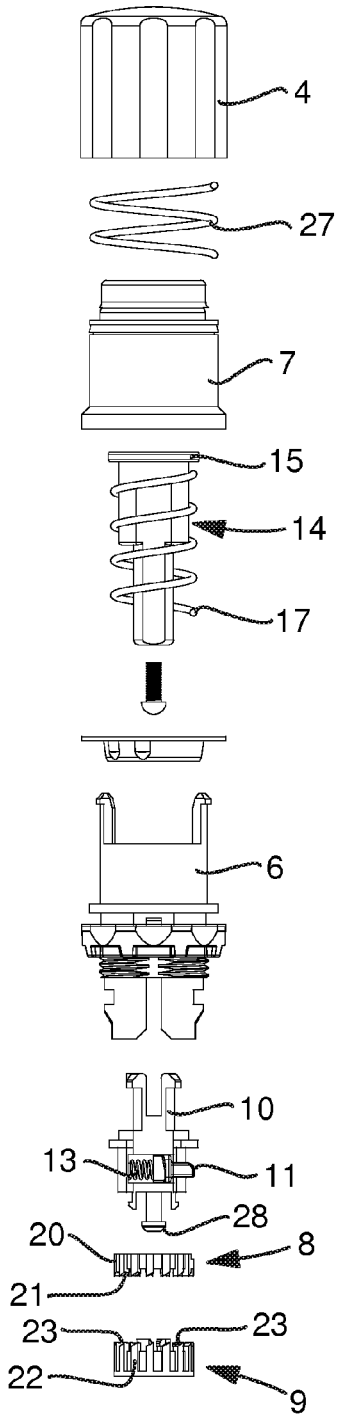
FIG. 4 is a second exploded view of the actuator device shown in FIGS. 1-3.
Figure 5:
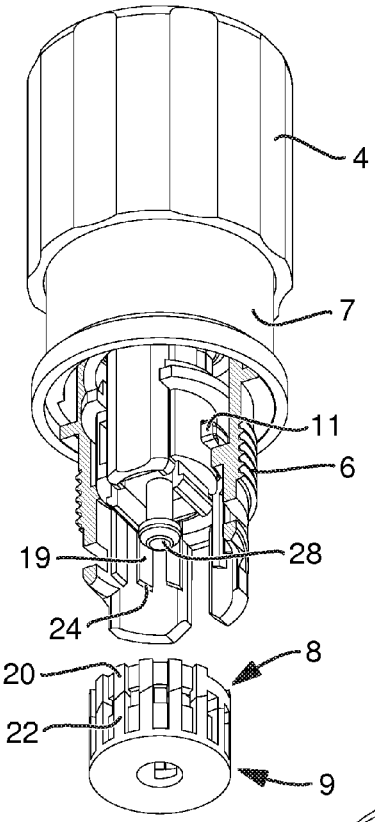
FIG. 5 is a perspective, partly cut and partly exploded view showing the guide means of the actuator device more clearly.
Figure 6:
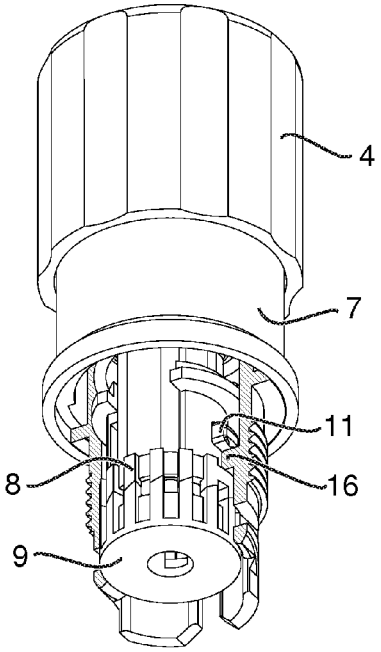
FIG. 6 is a partly cut perspective view showing the actuator device in the first position.
Figure 7:
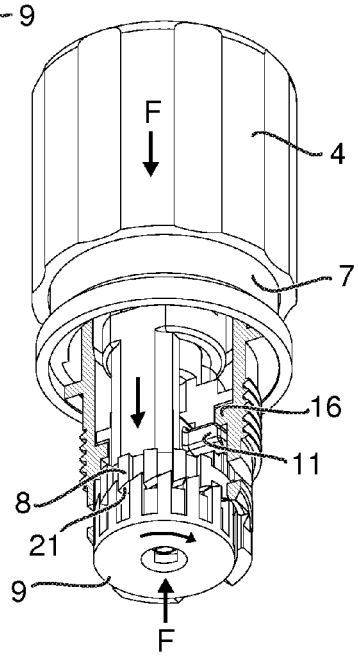
FIG. 7 is a partly cut perspective view corresponding to FIG. 6, showing the actuator device in the second position.

FIG. 1 shows a preferred embodiment of an actuator device 1 according to the invention. The actuator device 1 comprises a holder element 2, an actuator body 3, and a handle 4 connected to the actuator body 3. In FIG. 1 there is also indicated, with reference number 5, a device operated on by means of the actuator device. In the preferred embodiment the actuator device 1 is an emergency stop operator and the device 5 operated on is a contact block of a breaker of an electric machine. The actuator device 1 extends in its longitudinal direction towards the device 5 operated on. The longitudinal direction is the direction in which the actuator body 4 of the actuator device 1 is to be displaced in order to act on the device 5 operated on. In other words, the use of the word longitudinal does not mean that the actuator device necessarily is elongated in said direction.

The holder element 2 is fixedly connected to a frame 30 in which the device 5 operated on is fixedly located, and the actuator device 1 is arranged so as to displace a part, here a switch part 29, of the device 5 operated on in said longitudinal direction in order to close or break an electric circuit. The holder element 2 comprises a sleeve which, in its turn, is subdivided in an inner sleeve 6 and an outer sleeve 7. The handle 4 comprises a push-button arranged on the outer periphery of the holder element 2, and arranged to be displaced by a sliding motion on the latter in the longitudinal direction. The bush-button 4 is of tubular shape with an end wall or end cap at its end remote from the device 5 operated on.

The actuator body 3 comprises a first part 8, a second part 9 forming an end of actuator body towards the device 5 operated on, an intermediate part 10 onto which the first part 9 is non-rotationally attached and onto a central prolonging of which the second part 9 is rotationally arranged and longitudinally displaceably arranged. The second part 9 is prevented from full removal from first part 8 in the longitudinal direction by means of a stop element 28 formed by a knob at the end of the intermediate part 10. As an alternative the intermediate part 10 could as well be an integrated part of the first part 8. Accordingly, what is heretofore and hereinafter said concerning the intermediate part 10 may be valid for the first part 8 if, according to an alternative embodiment, the intermediate part would be an integrated part of the first part. In the actuator body 3, more precisely in a space in the intermediate part 10 thereof, there is provided a latch means 11 formed by a pin which is arranged so as to be displaced in a cross-wise, radial direction relative to said longitudinal direction.

There is provided an opening 12 in a wall of the intermediate for the passage of the pin 11 in said radial direction. In said space of the intermediate part 10 there is also provided a spring 13 that applies a force on the pin 11 in a radial direction from the centre of the intermediate part 10 towards the holder element 2, more precisely towards the inner sleeve 6 thereof.

The actuator device also comprises an actuator mechanism 14 through which the actuator body 3 is connected to the handle 4. The actuator mechanism 14 is directly connected to the handle 4 and displaceable in the longitudinal direction in relation to the actuator body 3 to a limited degree. The actuator mechanism 14 presents a sloping abutment surface 15 that upon displacement thereof in the above-mentioned first direction will push the pin 11 in a radial direction inwards. The intermediate part 10 of the actuator body 3 will not initially follow the motion of the mechanism 14 since the pin 11 abuts an abutment heel 16 provided on the inner periphery of the inner sleeve 6 of the holder element 2. The actuator mechanism 14 is fixedly connected to the handle 4 and may, as an alternative be regarded as a part thereof, and may even be an integrated part thereof. However, it is preferred that it is a separate part, e.g. for facilitating assembly and disassembly of the device.

There is provided a spring 17 that in one end thereof abuts the actuator mechanism 14 and in the other end thereof abuts an abutment of 18 on the intermediate part 10 of the actuator body 3. Thus the actuator mechanism 14 and the handle 4 is spring-loaded in relation to the actuator body 3 in the longitudinal direction by means of said spring 17. The force applied by the spring 17 is a pushing force acting so as to push the actuator mechanism 14 and the actuator body 3 away from each other in the longitudinal direction. However, such motion of the mechanism 14 and the body 3 is restricted by an engagement means formed by cooperating abutment heels 25, 26 on the mechanism 14 and the intermediate part 10 of the body 3 respectively.

Accordingly a pushing of the handle 4 in a first direction towards the device 5 operated on will result in an initial displacement of the actuator mechanism 14 up to a point at which the pin 11 is refracted enough to pass the abutment heel 16. Then the spring force of the spring 17 between the handle and the actuator body 3 will force the actuator body 3 in the first direction as the pin 11 goes free from the abutment heel 16. Thereby, the actuator body 3 is displaced in the first direction to such a degree that the pin passes the abutment heel 16. The actuator body 3 is also displaced in said first direction in relation to the actuator mechanism 14 such that the sloping abutment surface 15 of the latter will be retracted in relation thereto and will once again permit the pin 11 to project in the radial direction such that it once again overlaps and abuts the abutment heel 16, but now in a second position on the opposite side of the latter. In this second position the actuator mechanism 14 abuts the intermediate part 10 of the actuator body 3, by means of the cooperating abutment heels 25, 26, such that a pulling of the actuator mechanism 14 in a second direction opposite to said first direction will result in a corresponding displacement of the actuator body 3 in said second direction. The pin 11 is provided with an inclined abutment surface on the side that in, the second position of the actuator body 3, abuts the abutment heel 16. As a result thereof, the pin 11 will slide radially inwards and be refracted upon pulling of the actuator body 3 in the second direction, whereby the pin 11 will be able to pass the abutment heel 16 while going back to its first position in which it abuts the heel 16 on the opposite side thereof.

The inner sleeve 6 is provided with a guide means 19 formed by rims or splines extending in the longitudinal direction on the inner periphery of said sleeve. Up to a point when the second position is reached, the guide means 19 guides the first part 8 and the second part 9 of the actuator body 3 in the meaning that they prevent rotation thereof around a rotation axis parallel with the longitudinal direction as defined herein. When the second position of the actuator body 3 is being reached the second part 9 of the actuator body goes free from the guide means 19 in the meaning that it is no longer prevented from rotating by said guide means 19.

In order to engage the guide means 19, the first part 8 of the actuator body comprises projections 20 that extend in radial as well as in longitudinal direction on the outer periphery of said first part 8. The number of projections 20 correspond to the number of rims or splines on the guide means 19. At the axial end of each the projections closest to the second part 9 there is provided an inclined abutment surface 21 onto which a corresponding abutment surface of the second part 9 will bear in the first position and all the way to the second position of the actuator body 3. The first part 8 of the actuator body 3 may be regarded as a rotationally fixed gear.

The second part 9 also comprises projections 22 that extend in the longitudinal direction towards the first part 8 as well as in the radial direction in order to enable engagement with the guide means 19. The number of projections 22 of the second part 9 corresponds to the number of projections 20 of the first part 8, and with the number of rims or splines of the guide means 19. Each projection 22 of the second part 9 has an inclined abutment surface 23 at an end thereof directed towards the first part 8.

In the first position of the actuator body 3, the projections 20 of the first part 8 are in alignment with the projections 22 of the second part 9 such that they form continuous rims extending in the recesses formed between pairs of rims or splines of the guide means 19. The inclined abutment surfaces 21, 23 of the projections 20, 22 of the first and second part 8, 9 respectively, having the same inclination angle, will bear on each other in the first position.

During displacement of the actuator body 3 in the first direction and upon reaching the second position, however, in which the projections 22 of the second part 9 goes free from the guide means 19, the provision of the inclined abutment surfaces 21, 23 of the first and second part 8, 9, in combination with the presence of a counterforce from the object 5 operated on, will result in a sliding motion and a rotation of the second part 9 in relation to the first part 8 such that the abutment surfaces 23 of the second part 9 will slide into abutment against corresponding inclined abutment surfaces 24 at the ends of each of the rims or splines of the guide means 19. The first part 8 is displaced slightly more in the longitudinal direction such that the projections 20 thereof will engage the projections 22 of the second part 9, thereby preventing further rotation of the latter. Each abutment surface 24 at the end of each rim of the guide means has the same inclination direction and inclination angle as the abutment surfaces 21 at the ends of the projections 20 of the first part 8.

Provided that there is a counterforce from the device 5 operated on and that the handle is not pushed any further, a second, active position of the actuator device is reached as the first part 8 and the second part 9 engages each other by means of said projections 20, 22, thereby preventing any rotation of the second part 9 in relation to the first part 8. The abutment surfaces 23 of the projections 22 of the second part bear against the corresponding abutment surfaces 24 of the guide means 19. Thereby, the first part 8 is released from the action of the axial counterforce of the device 5 operated on. The counterforce in the longitudinal direction is fully adopted by the holder element 2, through the second part 9 of the actuator body 3 and the guide means 19 of the holder element. Thereby, the risk of having an accidental push-back of the actuator body 3 due to an excessive counterforce is avoided.

In order to return the actuator body 3 to the first, inactive position, the design according to the invention requires that the first part 8 of the actuator body be pulled back in the second direction from the second position towards the first position. Thereby, the rotationally locking engagement between the projections 20, 22 of the first part 8 and second part 9 respectively will cease, and, due to the counterforce from the device 5 operated on, the abutment surfaces 23 of the projections 22 of the second part will slide on the corresponding abutment surfaces 24 of the guide means 19, such that the second part 9 will rotate a further step and go back to the first position in which the projections 22 of the second part 9 are in alignment with the projections 20 of the first part and rotationally locked by the guide means 19. Thereby, the second part 9 is permitted to follow the first part 8 to the first position.

Further, the handle 4 is spring-loaded in the longitudinal direction in relation to the holder element 2 by means of a spring 27 that in one end abuts an end of the outer sleeve 7 of the holder element 2 and in the other end abuts the handle 4, and that extends helically along an inner periphery of the handle 4.

It should be emphasized that the above description of an embodiment has been made by way of example and that alternative embodiments will be obvious for a person skilled in the art, and that the scope of protection sought is only delimited by the appended claims, supported by the description and the annexed drawing.

The invention claimed is:

1. An actuator device, comprising:

a holder element provided to be fixed against a device operated on by the actuator device, an actuator body displaceable in a longitudinal direction along said holder element, a guide provided so as to guide said actuator body along said holder element, wherein said actuator body comprises a first part, which is operable from outside the actuator device, and a second part, which is movable in said longitudinal direction in relation to the first part, and wherein said actuator body is displaceable in said longitudinal direction from a first, non-actuated position to a second, actuated position, in which said second part is rotationally displaced in relation to said first part and abuts an abutment surface on the holder element such that motion of the second part in the longitudinal direction towards the first position is inhibited, wherein said first part comprises a rotational lock that engages said second part in said second position and locks the second part rotationally in the second position.

2. The actuator device according to claim 1, wherein in the first position, said first part and said second part are rotationally locked by said guide, and wherein in said second position only said first part is rotationally locked by said guide.

3. The actuator device according to claim 1, wherein said rotational lock comprises at least one projection projecting in the longitudinal direction of the first part.

4. The actuator device according to claim 3, wherein said rotational lock comprises an inclined abutment surface at an end thereof towards said second part.

5. The actuator device according to claim 3, said rotational lock comprises a plurality of projections projecting in the longitudinal direction of the first part.

6. The actuator device according to claim 5, wherein said plurality of projections are distributed along an annular path at the end of said first part.

7. The actuator device according to claim 1, wherein said second part comprises an engagement member arranged so as to engage said rotational lock in said second position.

8. The actuator device according to claim 7, wherein said engagement member comprises at least one projection projecting in the longitudinal direction of the second part.

9. The actuator device according to claim 8, wherein said at least one projection comprises an inclined abutment surface at an end thereof pointing towards said first part.

10. The actuator device according to claim 8, wherein said, in said first position, at least one projection of the second part is in longitudinal alignment with said at least one projection of the first part.

11. The actuator device according to claim 10, wherein said second part comprises a plurality of said projections, said projections being distributed along an annular path at an end of said second part pointing towards said first part.

12. The actuator device according to claim 1, wherein in said second position, said at least one projection of said second part is rotationally displaced in relation to a corresponding projection of the first part, and longitudinally displaced such that the at least one projection overlaps the first part in said longitudinal direction.

13. The actuator device according to claim 1, wherein said holder element comprises at least one abutment surface that, in said second position, abuts a corresponding abutment surface of the second part, thereby inhibiting said second part from moving longitudinally towards said first position.

14. The actuator device according to claim 13, wherein said at least one abutment surface of the holder element is inclined.

15. The actuator device according to claim 1, wherein in said second position, said inclined abutment surface of said at least one projection of said second part abuts a corresponding inclined abutment surface of the holder element.

16. The actuator device according to claim 15, wherein said guide comprises at least one rim extending in the longitudinal direction of the holder element.

17. The actuator device according to claim 16, wherein said guide comprises a plurality of rims extending in the longitudinal direction of he holder element and distributed on a peripheral surface of the holder element.

18. The actuator device according to claim 16, wherein said at least one inclined abutment surface of the holder element (2) is formed by an end of said guide.

19. The actuator device according to claim 1, wherein during displacement of the actuator body from the first position to the second position, the second part of the actuator body is arranged such that a force exerted by operation of the first part is applied to a device operated on through said second part.

20. The actuator device according to claim 1, wherein said second part is an end part of said actuator body, through which a reaction force from a device operated on by the actuator device in said second position will be transferred to the holder element through said abutment surface of the holder element.

21. The actuator device according to claim 1, further comprising:

a latch element that is displaceable in a direction crosswise to said longitudinal direction and wherein, in said second position of the actuator body, abuts a second abutment on the holder element, thereby preventing the first part of said actuator body from accidentally returning to the first position.

22. The actuator device according to claim 21, wherein at least one of said latch element or second abutment presents an inclined surface such that the latch element will be forced from abutting engagement with the second abutment upon pulling of said first part in a direction from the first to the second position.

23. The actuator device according to claim 22, wherein said latch element is spring loaded in a direction cross-wise to the longitudinal direction of the actuator device.

24. The actuator device according to claim 1, wherein said holder element is a sleeve inside which said actuator body is displaceably arranged.

25. The actuator device according to claim 1, wherein the actuator device is an emergency stop operator.

26. An electric switching device, comprising:

an actuator device a holder element provided to be fixed against a device operated on by the actuator device, an actuator body displaceable in a longitudinal direction along said holder element, a guide provided so as to guide said actuator body along said holder element, wherein said actuator body comprises a first part, which is operable from outside the actuator device, and a second part, which is movable in said longitudinal direction in relation to the first part, and wherein said actuator body is displaceable in said longitudinal direction from a first, non-actuated position to a second, actuated position, in which said second part is rotationally displaced in relation to said first part and abuts an abutment surface on the holder element such that motion of the second part in the longitudinal direction towards the first position is inhibited, wherein said first part comprises a rotational lock that engages said second part in said second position and locks the second part rotationally in the second position, and an electric device on which the actuator body of the actuator device exerts a force in said longitudinal direction and to which the holder element of the actuator device is fixedly attached.

27. The electric switching device according to claim 26, wherein said actuator device is an emergency stop operator and wherein said electric device comprises a contact block to be acted on by the emergency stop operator.

* * * * *